US005088310A

United States Patent [19]

Anagnostopoulu

[11] Patent Number: 5,088,310

[45] Date of Patent: Feb. 18, 1992

[54] ADDITIONAL BENDER OF METAL WIRE WORKING MACHINES FOR CREATION OF THREE DIMENSIONAL SHAPES (FORMS)

[76] Inventor: Maria Anagnostopoulu, Velissariou 1, Cholargos, Greece

[21] Appl. No.: 505,682

[22] Filed: Apr. 9, 1990

[30] Foreign Application Priority Data

Apr. 11, 1989 [GR] Greece ..... 890100232

[51] Int. Cl.[5] ..... B21D 7/024

[52] U.S. Cl. ..... 72/306; 72/217; 72/388

[58] Field of Search ..... 72/307, 306, 215–219, 72/387, 388, 149, 446, 444

[56] References Cited

U.S. PATENT DOCUMENTS

| | | | |
|---|---|---|---|
| 1,272,552 | 7/1918 | Spencer | 72/217 |
| 3,857,271 | 12/1974 | Gott | 72/306 |
| 4,021,669 | 5/1977 | Gott | 72/217 |
| 4,653,301 | 3/1987 | Meliga | 72/174 |
| 4,662,204 | 5/1987 | Saegusa | 72/306 |
| 4,735,075 | 4/1988 | Saegusa | 72/217 |
| 4,961,335 | 10/1990 | Kimura | 72/217 |
| 5,052,277 | 9/1962 | Stegmann | 72/307 |

FOREIGN PATENT DOCUMENTS

| | | | |
|---|---|---|---|
| 803970 | 4/1951 | Fed. Rep. of Germany | 72/217 |

*Primary Examiner*—Daniel C. Crane

*Attorney, Agent, or Firm*—Cushman, Darby & Cushman

[57] ABSTRACT

This invention has concentrated on the construction of an extra bending mechanism which by appearing at the right moment, creates wire/rod bends always in relation with the above mentioned line x—x, but within other planes E2, also containing line x—x 15 but distinctly different than plane E1. In this manner it is possible to achieve the construction of wire shapes in three dimensions.

7 Claims, 1 Drawing Sheet

ADDITIONAL BENDER OF METAL WIRE WORKING MACHINES FOR CREATION OF THREE DIMENSIONAL SHAPES (FORMS)

BACKGROUND OF THE INVENTION

The currently existing automatic wire/rod straightening and bending machines create planar wire or rod shapes which normally lie within a fixed and standard plane E1, which contains the imaginary line x—x of the straightened wire.

SUMMARY OF THE INVENTION

The invention consists of constructing one system for bending metallic rods (hereafter called "bender") which, when fitted on existing—automatically bending metallic rods and forming planar shapes—machines, gives an additional possibility to these machines to form shapes of metallic rod in space or as it is normally called "three-dimensional shapes".

DETAILED DESCRIPTION OF THE DRAWINGS

DETAILED DESCRIPTION OF THE PREFERRED EMBODIMENT

Figure 1:
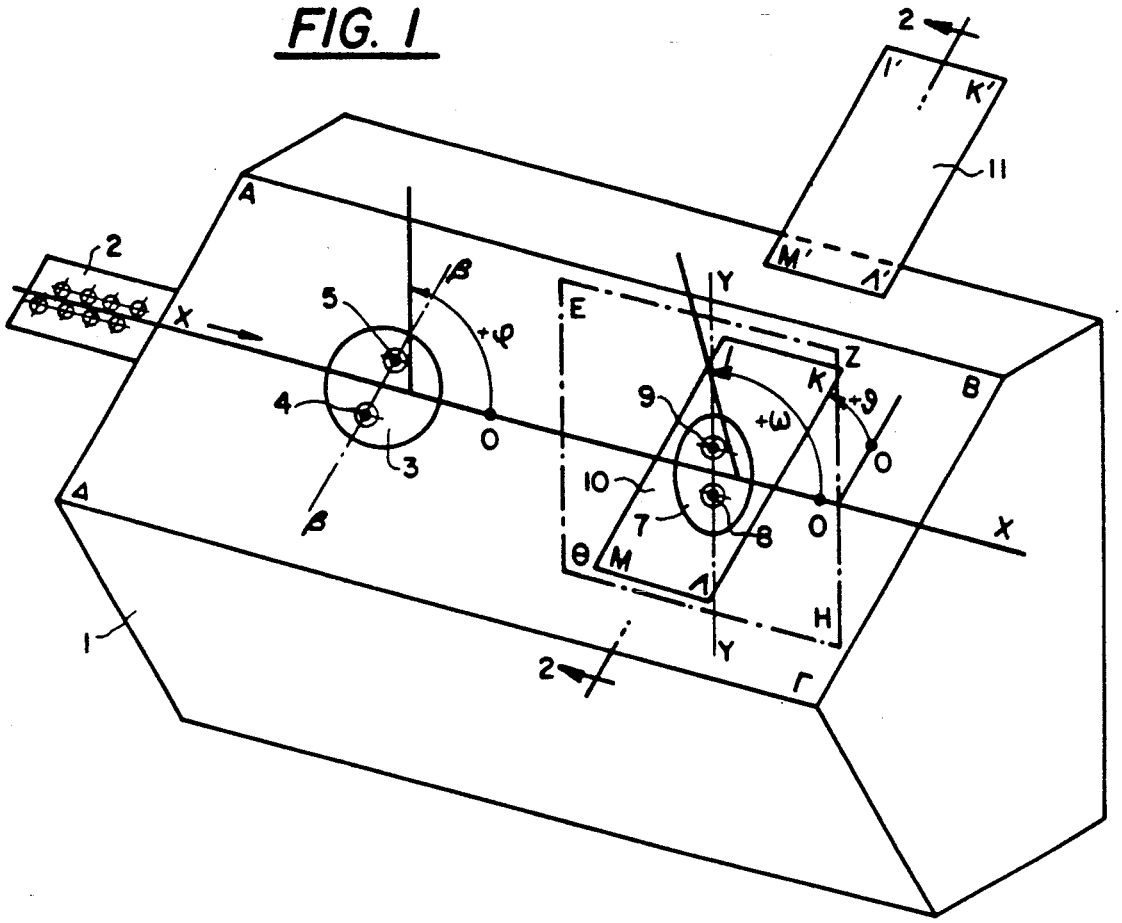
FIG. 1 is a schematic perspective view of the machine in accordance with the invention.
Figure 2:
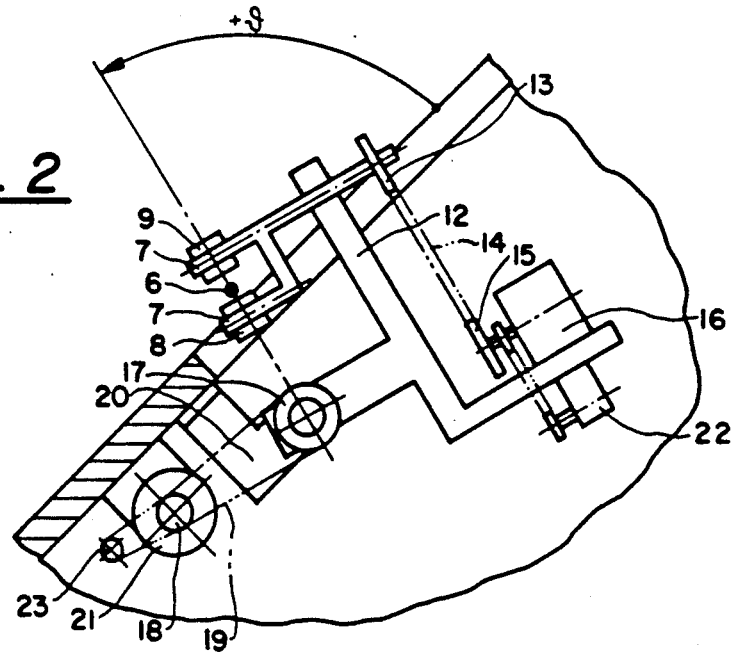
FIG. 2 is a cross-sectional view of the machine taken along line a—a of FIG. 1.

The invention can easily be understood with reference to the accompanying design of FIG. 1. The naming of the parts necessary for the description of the invention has as follows:

1. Body of existing machine creating planar shapes from metallic rod.
2. Existing mechanisms of advancing-straightening rod or wire.
3. Existing bender.
4. Existing bender's right pin.
5. Existing bender's left pin.
6. Metallic rod of stirrup shapes formation.
7. New (adaptable) bender.
8. New bender's mobile pin.
9. New bender's fixed pin.
10. Window.
11. Window cover.
12. New bender's body.
13. Mobile pin's rotation second sprocket.
14. Pin's rotation chain.
15. Mobile pin's rotation first sprocket.
16. Hydraulic motor of pin's motion.
17. Body's rotation second sprocket.
18. Body's rotation first sprocket.
19. Body's rotation chain.
20. Body's rotation base.
21. Body's rotation hydraulic motor.
22. Rod bending sensors (measuring angle $\omega$).
23. Planar rod bending sensor (measuring angle $\theta$).

The operation of any existing machine producing stirrup shapes from metallic rod is as follows:

The existing mechanism of feeding-straightening metallic rod, pushes the rod for a certain length with subsequent right ($\phi-$) or left ($\phi+$) bends resulting in the formation of a planar shape, for example a square frame with sides of 25 cm. Such construction is done as follows:

Rod advancement from line $\beta$—$\beta$ of existing bender by 25 cm.

Straightening mechanism stops.

Bending by: $\phi=+90°$.

Bender (3) returns to initial position and stops.

Rod advancement by 25 cm.

Bending by 90°, etc.

(The cutting of the rod and the separation of the stirrup shape is done by an appearing cutter which is not designed here).

The bending of the metallic rod (6) on plane EZHΘ other than the plane of the machine ABΓΔ (on which old planar shapes were produced) is done as follows:

First, a window I'K'Λ'M' opens and an opening IKΛM is formed on the plane of the machine ABΓΔ.

Second, the new bender (7) appears which locates the rod between its fixed pin and its mobile pin.

Third, the final position of the new bender (7) is such that the following bend of the metallic rod by an angle ($\omega$) is done on the plane EZHΘ (which forms an angle $\theta$ respect to the plane of the machine ABΓΔ).

The angle, ($\omega$) i.e. the bend of the metallic rod on plane EZHΘ is between 0° and 180°:$0° < \omega < 180°$.

The angle $\theta$, i.e. the tilt of the plane of bending EZHΘ with respect to the plane of the machine ABΓΔ is between 0° and 180°:

$$0° < \theta 180°.$$

By different ways, we can bring the new bender in such position that the bent rod gets given angles ($\omega$) and ($\theta$).

In section $\alpha$—$\alpha$ we give as indication the aspect of a mechanism that creates the angles ($\omega$) and ($\theta$).

For the rotation and appearance of the bender (7) the hydraulic motor (21) is used which brings by means of sprockets 18 & 17 and chain 19 the body of the bender (12) to a given angle $\theta$. The computer detects this angle through the electronic sensor (23).

For the rotation of the bender (7) on plane EZHΘ and revolution of the mobile pin around the fixed pin (9) in order to achieve the bend of the rod by an angle ($\omega$), the hydraulic motor (16) is used with transmission on sprockets (13),(15) and chain 14. The computer detects the angle ($\omega$) through the electronic sensor (22).

The window I'K'Λ'M' opens automatically by means of a piston.

I claim:

1. A metal wire working machine for forming three dimensional shapes in metal wire comprising:

a housing;

means for feeding a length of metal wire to said housing;

means for bending wire fed to said housing in a first plane;

a bender body pivotally mounted to said housing, downstream from said means for bending wire;

means for pivoting said bender body about said pivotal mounting through an angle $\theta$ in a second plane, said second plane being substantially perpendicular to said first plane;

a bender element rotatably mounted to said bender body at a point spaced from said pivotal mounting of said bender body to said housing; and means for rotating said bender element about a longitudinal axis thereof through an angle $\omega$ in a third plane disposed substantially perpendicular to said second plane, said third plane being angularly offset from said first plane;

said bender body being pivotal through said angle Θ to dispose said bender element in a position adjacent to a length of wire fed to said housing, said bender element including means for engaging the length of wire fed to said housing so that rotation of said bender element about said longitudinal axis, after said bender body has been pivoted through said angle Θ, bends said metal wire in said third plane by said angle ω.

2. A machine as in claim 1, wherein said bender element includes a fixed pin element and a movable pin element, said fixed pin element being coaxial with said longitudinal axis of said bender element, said mobile pin element being laterally spaced from said fixed pin element whereby rotation of said bender element about said longitudinal axis through an angle ω revolves the mobile pin around said fixed pin and said longitudinal axis so as to bend a wire disposed between said fixed pin and said mobile pin by said angle ω.

3. A machine as in claim 1, wherein said bender body includes a substantially L-shaped portion, a first arm of said L-shaped portion being pivotally mounted at a free end thereof to said housing, said bender element being rotatably mounted to a free end of a second arm of said arms of said L-shaped portion.

4. A machine as in claim 1, wherein said means for rotating said bender body comprise a first sprocket element defined at said pivotal mounting and a second sprocket element fixedly coupled to said housing and spaced from said first sprocket element, a chain element interconnecting said first and second sprocket elements, and motor means for rotating said second sprocket.

5. A machine as in claim 1, wherein said means for rotating said bender element comprise a first sprocket element mounted to a longitudinal end of said bender element, a second sprocket element mounted to said bender body, a chain element interconnecting said first and second sprocket elements, and means for rotating said second sprocket so as to rotate said bender element about said longitudinal axis thereof.

6. A machine as in claim 1, wherein said housing includes a wall defining a work surface;

said means for feeding wire comprises means for feeding wire to said work surface;

means defining an aperture in said work surface;

said bender body being pivotally mounted to an interior surface of said housing and being pivotal relative to said housing so that said bender body is pivotal in a plane disposed substantially perpendicular to said work surface, through an angle Θ from said work surface outwardly;

said bender element being rotatably mounted to said bender body so as to be rotatable in said first plane which is disposed substantially perpendicular to said second plane through which said bender body rotates and is disposed at an angle Θ relative to said work surface.

7. A metal wire working machine as in claim 1, wherein said third plane is angularly offset from said first plane by said angle Θ.

* * * * *